United States Patent [19]

Fanslau et al.

[11] Patent Number: 4,527,829

[45] Date of Patent: Jul. 9, 1985

[54] FOLDABLE WHEEL CHAIR, ESPECIALLY FOR INVALIDS

[75] Inventors: Udo Fanslau, Hamburg; Norbert Grosche, Jork, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 381,523

[22] Filed: May 24, 1982

[30] Foreign Application Priority Data

May 27, 1981 [DE] Fed. Rep. of Germany ..... 3121127

[51] Int. Cl.[3] ..... A47C 4/20; A61G 5/00

[52] U.S. Cl. ..... 297/17; 297/16; 297/29; 297/51; 297/346; 297/347; 297/DIG. 4

[58] Field of Search ..... 297/346, 347, 16, 17, 297/29, 30, 51, 52, 53, 54, DIG. 4, 335, 337

[56] References Cited

U.S. PATENT DOCUMENTS

| | | | |
|---|---|---|---|
| 2,429,763 | 10/1947 | Lindabury | 297/17 |
| 2,545,336 | 3/1951 | Binder | 297/17 |
| 2,849,051 | 8/1958 | Streeter, III | 297/347 |
| 3,029,106 | 4/1962 | McGuire | 297/347 |
| 3,261,031 | 7/1966 | Gates | 297/DIG. 4 |
| 3,596,982 | 8/1971 | Grams | 297/347 |
| 3,889,963 | 6/1975 | Brattgard | 297/DIG. 4 |
| 4,229,039 | 10/1980 | Day | 297/16 |
| 4,266,305 | 5/1981 | Kavaloski et al. | 297/DIG. 4 |
| 4,343,482 | 8/1982 | Wegner | 297/DIG. 4 |

FOREIGN PATENT DOCUMENTS 2637478 2/1978 Fed. Rep. of Germany .

*Primary Examiner*—William E. Lyddane
*Assistant Examiner*—Mark W. Binder
*Attorney, Agent, or Firm*—W. G. Fasse; D. H. Kane, Jr.

[57] ABSTRACT

The present wheel chair, especially for invalids, is foldable in a vertical direction rather than horizontally to transform the chair into a very compact package. For this purpose all foldable components of the chair are equipped with journals having journal axes extending perpendicularly to a vertical central plane of symmetry of the chair. Further, the seat is vertically liftable and also horizontally guided on guide tracks (18) extending in parallel to the plane of symmetry of the chair. The guide tracks (18) are movable back and forth on guide rail sections (17) which are pivoted to the top of the support structure (4) of the chair. Hydraulic piston cylinder drives are connected to all chair components which are movable under a loaded condition with a person sitting in the chair. The chair seat is also divided so that the chair may be moved directly over a toilet seat, for example. By raising the chair seat sufficiently above the arm rests in the aisle of an aircraft or bus, a person may be transported directly to a passenger seat with the aid of the present chair.

16 Claims, 13 Drawing Figures

FIG.10
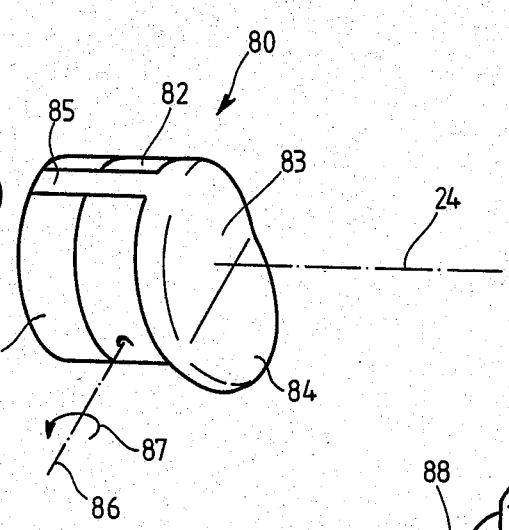
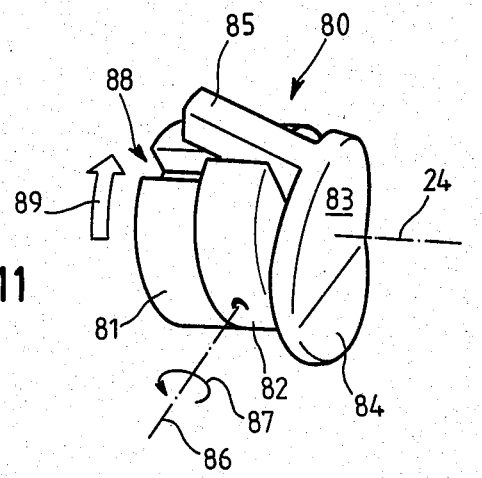
FIG. 11
FIG. 12
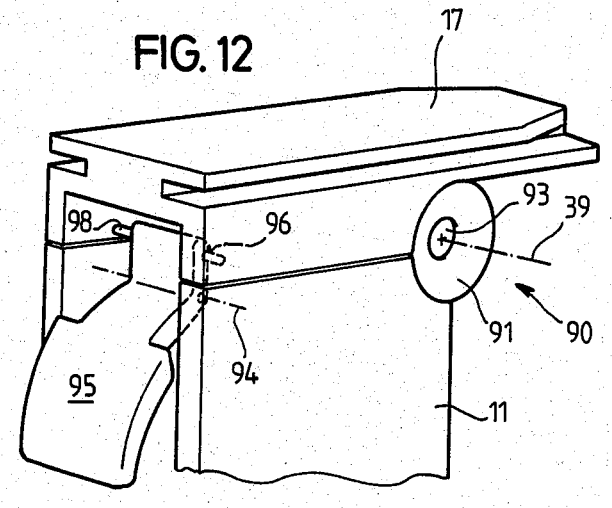
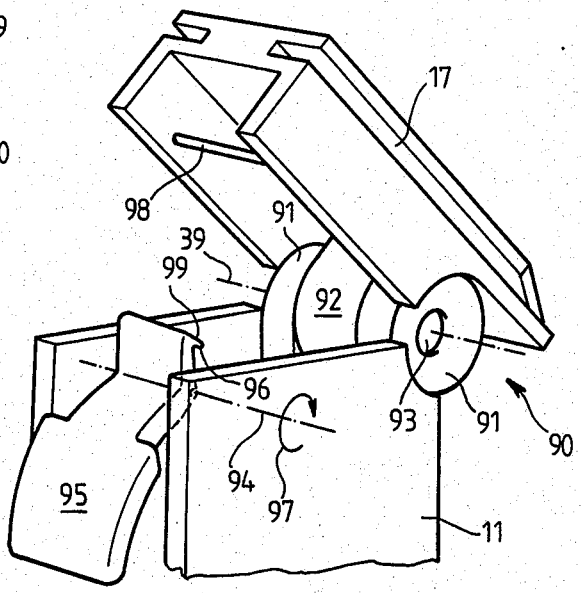
FIG. 13

FOLDABLE WHEEL CHAIR, ESPECIALLY FOR INVALIDS

CLAIM TO PRIORITY

The present application is based on German Serial No. P 31 21 127.5, filed in the Federal Republic of Germany on May 27, 1981. The priority of the German filing date is claimed for the present application.

BACKGROUND OF THE INVENTION

The invention relates to a foldable wheel chair, especially for invalids. Such wheel chairs normally comprise a number of components forming a base, a supporting structure for the seat, and a backrest as well as a seat.

German Patent Publication (DE-AS) No. 2,637,478 discloses a foldable wheel chair which is folded in a direction toward its central plane of symmetry. Such central plane of symmetry extends vertically through the middle of the entire chair. In the prior art chair the brackets for the backrest are inserted into a tubular member of the supporting structure. This type of folding is possible only because the seat as well as the backrest are made of a foldable material, such as cloth. Additionally, it is necessary to first remove the backrest and to pull out a holding pin prior to the insertion of the brackets for the backrest. Another drawback of this type of prior art wheel chair is seen in that it is suitable only for riding and that it cannot be used by the invalid in situations where a vertically adjustable seat would be desirable, for example, for placing the wheel chair over a toilet.

OBJECTS OF THE INVENTION

In view of the above it is the aim of the invention to achieve the following objects singly or in combination:

to construct a foldable wheel chair in such a manner that its folding features are simple to facilitate the folding into a compact package;

to provide a wheel chair with a vertically adjustable seat so as to adjust the elevation of the seat to different use requirements, for example, for placing the wheel chair seat above a toilet;

to provide a foldable wheel chair which can be folded in a direction extending in its central plane of symmetry;

to make the wheel chair narrow enough in the horizontal direction so that it may even travel, for example, along an aisle in an aircraft; and to enable the user of the wheel chair to slide laterally from the seat of the wheel chair onto some other support at the same elevational level.

SUMMARY OF THE INVENTION

According to the invention there is provided a wheel chair including substantially a base, a support structure for the seat, and a seat with its backrest, wherein all essential individual components are provided with journal means having axes extending across the above mentioned plane of symmetry or at right angles thereto so that the folding may take place in a direction extending in said plane of symmetry. Thus, all journal axes required for this type of folding extend substantially horizontally. Further, the seat is equipped at its underside with guide track means extending in parallel to said vertical central plane. Guide rail sections pivoted to the support structure slide in the guide track means for moving the seat horizontally back and forth.

These basic features of the chair according to the invention allow for a very simple foldability and also permit to shift the seat rearwardly which in combination with a foldable center portion of the seat make it possible to move the wheel chair seat over a toilet, whereby the invalid is not required to change his position on the wheel chair. Rollers at the rear edge of the seat proper facilitate the rolling of the wheel chair seat onto a toilet, for example, in an aircraft. Prior to rolling the wheel chair seat onto a toilet the elevational level of the wheel chair set is adjusted to be slightly above that of the top of the toilet, if necessary.

A further advantage of the wheel chair according to the invention is seen in its relatively narrow width in the horizontal direction from side to side so that the chair may be moved through relatively narrow aisles such as in an aircraft or in a public bus. In this connection the elevational adjustment of the seat enables the user to adjust the seat of the wheel chair to the level of the seat in the public transportation so that he may slide over sideways onto the seat in the public transportation such as a bus. These features make it possible that even a heavy person may be transported to his seat and/or to a toilet in a public transportation vehicle or aircraft.

BRIEF FIGURE DESCRIPTION

In order that the invention may be clearly understood, it will now be described, by way of example, with reference to the accompanying drawings, wherein:

FIG. 10 shows a perspective view of a locking device in its locked condition for arresting a tiltable member in a fixed position relative to a member to which the tiltable member is secured;

FIG. 11 shows perspectively the locking device of FIG. 10 in its unlocked condition;

FIG. 12 shows a perspective view of an arresting mechanism in its arresting position for securing two foldable chair components to each other, thereby preventing their tilting relative to each other; and FIG. 13 shows a perspective view of the arresting device of FIG. 11 in releasing position thereby permitting the tilting of the two foldable chair components relative to each other.

DETAILED DESCRIPTION OF PREFERRED EXAMPLE EMBODIMENTS AND OF THE BEST MODE OF THE INVENTION

Figure 1:
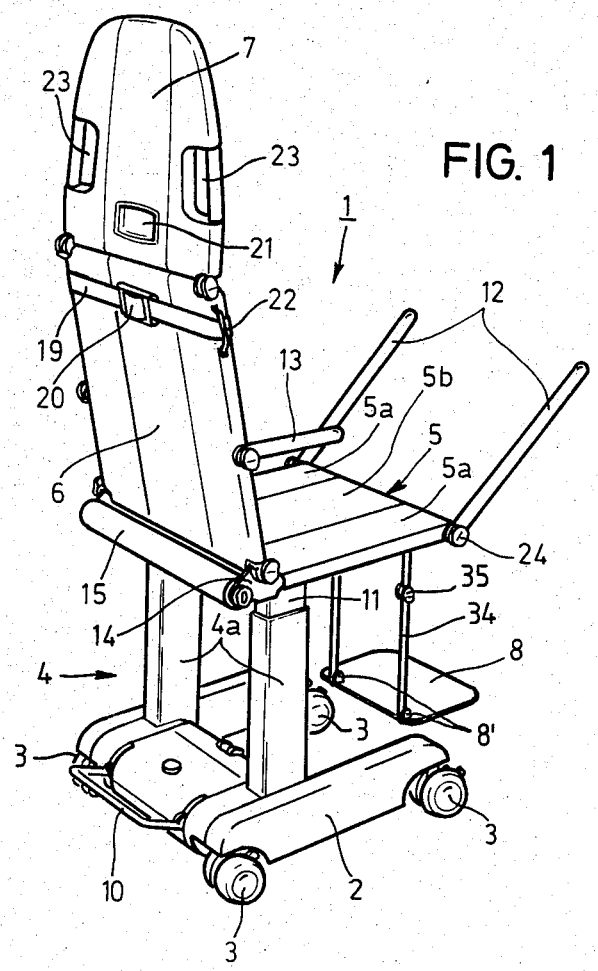
FIG. 1 is a perspective view of a chair according to the invention.
Figure 2:
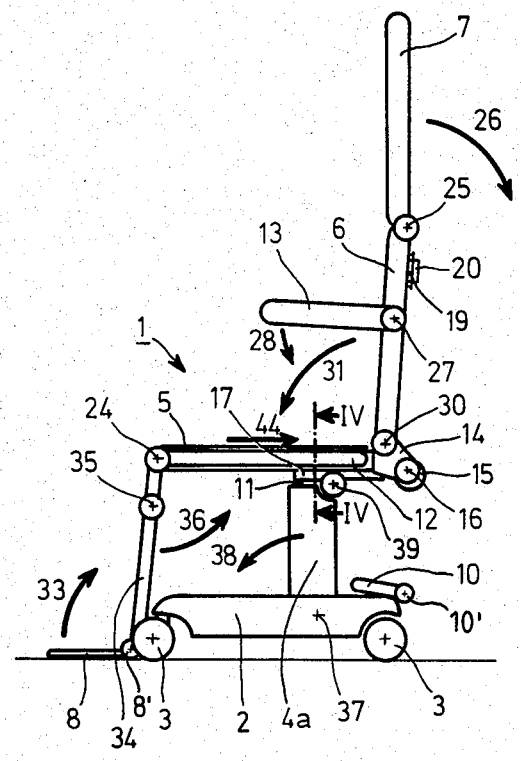
FIG. 2 is a side view of the present wheel chair, whereby structural details have been omitted to emphasize the several journal means provided for the folding features according to the invention.
Figure 4:
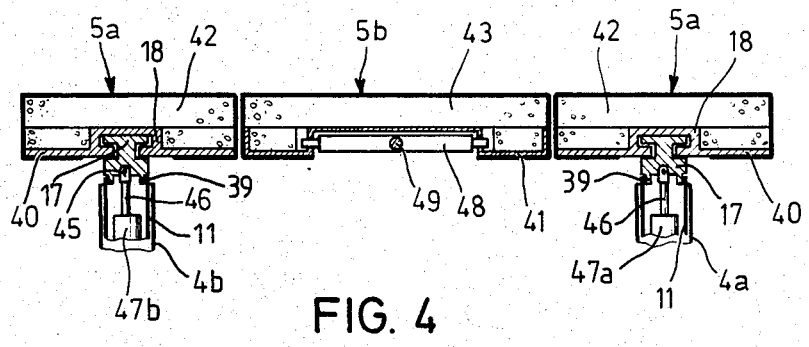
FIG. 4 is a sectional view along section line IV—IV in FIG. 2.

Referring to FIGS. 1 and 2 a wheel chair 1 comprises substantially a base 2 carrying several components to be described in more detail below and equipped with wheels or rollers 3. The chair further comprises a foldable support structure 4 including telescoping tubing members 4*a* and 11. The tubing members 11 are slidable up and down in the tubing members 4*a* as will be described below. The seat 5 is secured to the top of the support structure 4 as best seen in FIG. 4. The seat 5 carries a backrest including a lower backrest portion 6 and an upper headrest portion 7. The seat further carries a footrest 8 hinged to connecting rods 34 by hinging journal members 8'.

The base 2 carries a bail 10 which may be operated as a foot pedal for activating the elevating means for the seat 5 also as will be described below. Two handle bars 12 are secured in a pivoting or journalling manner to the front edge of the seat 5. FIG. 2 shows the handle bars 12 in the folded position alongside the seat 5. The handle bars 12 serve for pushing the wheel chair 1 by an attendant. The user of the wheel chair may also hold onto these handle bars 12.

The seat 5 comprises a fixed U-shaped portion including two side sections 5*a* spaced from each other and opening toward the front edge. The seat further comprises a central section 5*b* fitted into the spacing between the side sections 5*a* and tiltable downwardly as will be described below.

One or several rollers 15 for rolling on a seat supporting surface are secured to the rear edge of the seat 5 by a bracket 14 for rotation about a journal axis 16 extending perpendicularly to the central plane of symmetry of the chair.

Referring to FIG. 4 the tubular members 4*a* and 11 are preferably of rectangular cross-sections. The top of each tubular member 11 is operatively connected to a rail section 17 which in turn slides back and forth in a guide track 18 secured to the bottom of the respective side seat section 5*a*.

Referring again to FIG. 2 the tubular members 4*a* of the support structure 4 are pivoted to the base 2 by fourth journal means represented by a journal axis 37, whereby the tubular members 4*a* or upright posts are tiltable in the direction of the arrow 38 into a position in which the upright posts 4*a* extend in parallel to the side rails of the base 2. Incidentally, the handle bars 12 and the central section 5*b* of the seat are tiltable about a sixth journal axis 24 extending along the front edge of the seat 5. A first journal axle or axis 25 secures the headrest portion 7 to the lower backrest portion 6 for tilting in the direction of the arrow 26 backwardly, whereby the headrest portion 7 may be tilted against the rear of the backrest portion 6. The lower portion 6 of the backrest in turn is tilted to the rear edge of the seat by second journal axle means 30, whereby the backrest 6 may be tilted toward the surface of the seat in the direction of the arrow 31. Further, after tilting the footrest 8 about its hinge 8' in the direction of the arrow 33 the braces 34 are tiltable about a third journal means 35 in the direction of the arrow 36, whereby the foot rest means come to be located below the seat 5. A fifth journal axis 39 is provided by pivot means connecting the top of the support structure to the rail sections 17, thereby permitting the tilting of the upright posts 4*a* in the direction of the arrow 38 as described above while simultaneously permitting the seat 5 to remain in a horizontal position substantially at all times. The arm rests 13 are journalled to the backrest 6 by seventh journal axle means 27 enabling the pivoting of the arm rests 13 downwardly in the direction of the arrow 28.

It will be noted that all the above mentioned journal axes 1 to 7 extend perpendicularly to the plane of the drawing and thus perpendicularly to a central plane of symmetry extending vertically through the chair. The additional pivots 8' also have a journal axis extending perpendicularly to said central plane of symmetry. This also applies to the pivot 10' for the bail 10.

Figure 3:
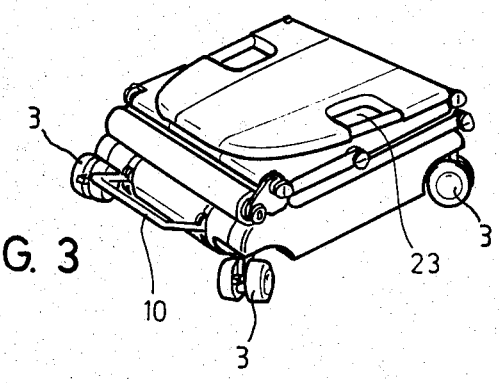
FIG. 3 shows the compact package into which the present wheel chair may be folded.

In order to avoid that the seat extends too far in front of the base 2 when the upright posts 4*a* are folded down in the direction of the arrow 38 out of their normal upright position, the rail sections 17 and the guide tracks 18 are of such a horizontal length, that the seat 5 may be pushed sufficiently backwardly in the direction of the arrow 44, whereby the compact package shown in FIG. 3 is achieved. When the chair is in the folded position shown in FIG. 3, it may be carried by one of the handles 23 or by the bail 10. Referring further to FIG. 2 and as shown in FIG. 1, an automatic seat belt 19 is secured to the backrest 6 including a take-up roller means and runs through eyelets 22 attached to the sides of the backrest 6. As shown, the handles 23 are formed in the headrest portion 7. However, if desired, such handles may also be formed in the backrest 6. Incidentally, the bail 10 is also foldable about the pivot axis 10' as shown in FIG. 2.

Referring again to FIG. 4 the two side sections 5*a* of the seat forming a U-shaped frame with the central section 5*b* therebetween are interconnected along the front edge of the seat by the second journal axis 24. Each side section 5*a* has a frame member 40 covered by seat cushions 42. The central section 5*b* has a frame member 41 also covered by a cushion 43. The frame members 40 have attached thereto or form integrally the guide tracks 18 for the guide rail sections 17 which slide in these guide tracks 18. The inner tubular members 11 are journalled or pivoted at 39 to the slide rail sections 17. A forked end 45 of each piston rod 46 is also pivoted to the respective rail section 17. The piston rods 46 for elevating the seat are driven by pistons in cylinders 47*a* and 47*b* by hydraulic pressure as will be described in more detail below with reference to FIGS. 6 and 7. The center section 5*b* is provided with a handle 48 attached to a rod 49 reaching into a catch at the rear end of the center section 5*b* when the latter is in its normal horizontal position. When the rod 49 is withdrawn from its catch with the handle 48, the center section 5*b* tilts downwardly around the second journal means 24 into a position shown in FIG. 8.

Figure 5:
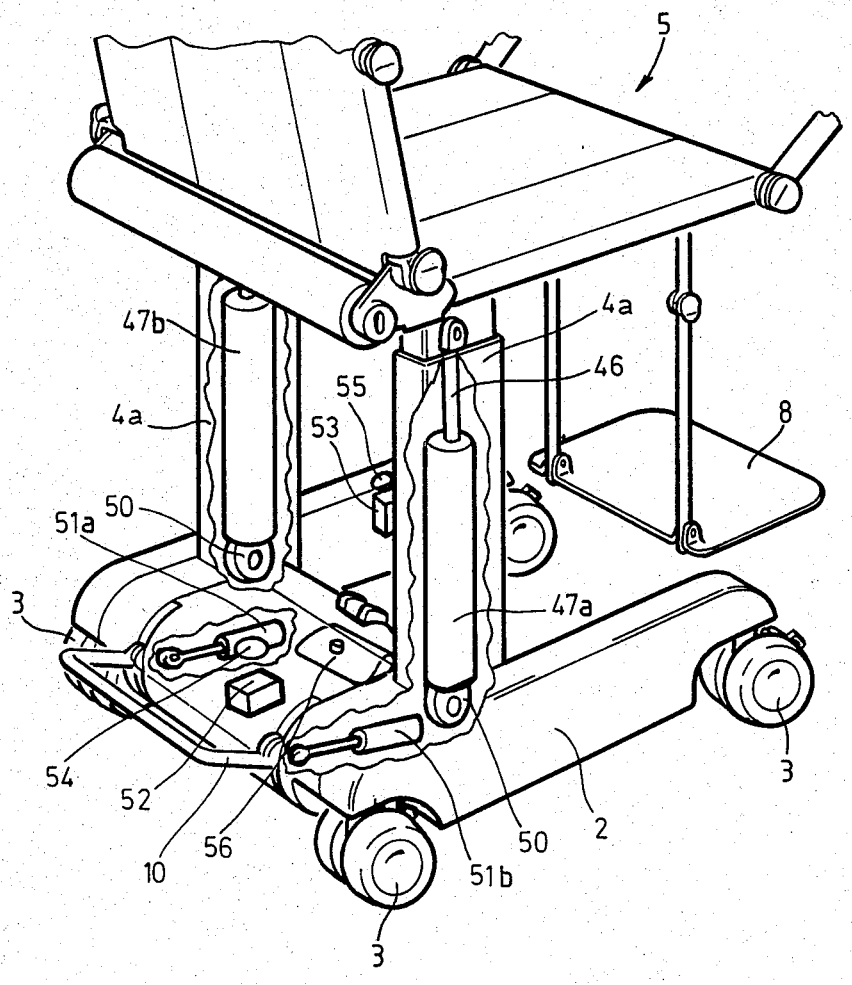
FIG. 5 is a similar view as FIG. 1 on an enlarged scale and showing only the lower portion of the present chair with the means for elevating the seat to different levels.

FIG. 5 shows the hydraulic piston cylinder means 47*a* and 47*b* in full lines although normally these piston cylinders will be hidden inside the tubular upright posts 4*a*. Further, in order not to obscure the illustration, the hydraulic connecting conduits such as rubber hoses are not shown in FIG. 5. The cylinders 47*a*, 47*b* are pivoted to the base 2 in a pivot member 50 to permit the above mentioned tilting of the upright posts 4*a* about the pivot axis 37 into the horizontal position in the base 2 as described above. The pistons in the cylinders 47*a* and 47*b* are driven by pump means, for example, comprising two pump cylinders 51*a* and 51*b* operable by a foot pedal in the form of the bail 10. Two seat lowering valves 52 and 53 are also shown in FIG. 5. These valves are provided with actuating buttons 54 and 55 which may be operated manually or by foot. The operating buttons 54 and 55 are located in different positions so that at least one of these buttons may be reached at all times. These buttons and thus the corresponding valves 52 and 53 are operable independently of each other. The base 2 further carries a container 56 for a hydraulic fluid.

Figure 6:
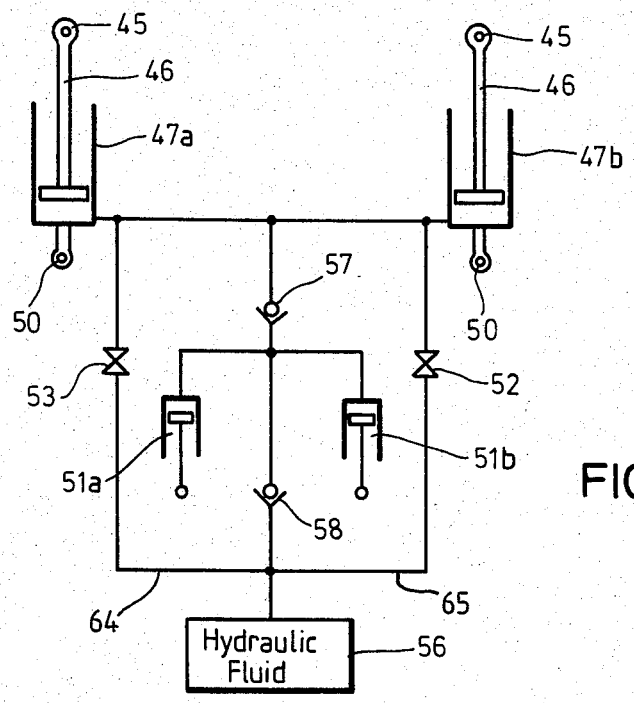
FIG. 6 shows a hydraulic circuit diagram for the seat elevating means, whereby two hydraulic control circuits have a common suction and pressure circuit path.

FIG. 6 illustrates a hydraulic circuit diagram of the components just described above, especially with reference to FIGS. 4 and 5. The pressure section of the hydraulic circuit is connected through the non-return valve 57 to the cylinders 47*a* and 47*b*. The suction section of the hydraulic circuit is connected through the non-return valve 58 to the pump cylinders 51*a* and 51*b*. As mentioned, both pistons of the pump cylinders 51*a*, 51*b* are operated in unison by the bail 10. The control branches with the valves 52 and 53 are arranged in parallel in the circuit so that any one of the two valves 52 or 53 may be used for lowering the seat 5. The circuit of FIG. 6 operates as follows. By pumping the bail 10 the hydraulic fluid is conveyed by suction out of the container 56 into the pump cylinders 51*a* and 51*b* and during the pumping stroke the fluid under pressure is conveyed through the non-return valve 57 into the cylinders 47*a*, 47*b*, whereby the seat 5 is lifted. If the pumping operation is stopped, the seat remains in its respective position since the valve 57 prevents a return flow. Lowering of the seat is possible only through any one of the valves 52 or 53 when the respective valve is operated by pushing the button 54 or 55.

Figure 7:
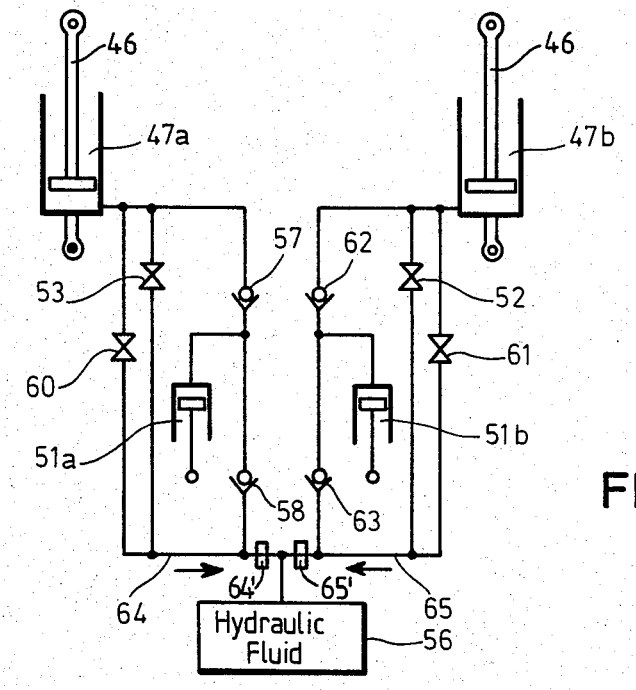
FIG. 7 shows another version of a hydraulic circuit arrangement for the seat elevating means.

FIG. 7 illustrates a hydraulic circuit diagram with two separate branches even for the suction and pressure path. Thus, in addition to the non-return valves 57 and 58 there are provided further non-return valves 62 and 63 as well as two additional seat lowering valves 60 and 61 connected in parallel respectively to the seat lowering valve 53 and to the seat lowering valve 52. By providing a separate hydraulic circuit for each cylinder 47*a*, 47*b* it is assured that the pump cylinder 51*a* feeds only the lifting cylinder 47*a* and that the pump cylinder 51*b* feeds only into the lifting cylinder 47*b*, whereby an exact, synchronized movement of the piston rods 46 is assured. The seat lowering valves 52 and 60 are mechanically coupled to each other. The seat lowering valves 53 and 61 are also mechanically coupled to each other, whereby the valves forming a pair can only be actuated in unison.

Further, in the return path 64 there is arranged a flow meter 64' of conventional construction. A further flow meter 65' of the same construction is arranged in the return flow path 65. The pistons of these two flow meters 64' and 65' are rigidly connected to each other so that both return flow conduits 64 and 65 are controlled to permit equal quantities of fluid to flow back into the hydraulic fluid container 56 out of both separate circuits at any one instance. This feature further improves an exact uniform operation of the two piston rods 46 for lowering the seat 5.

Figure 8:
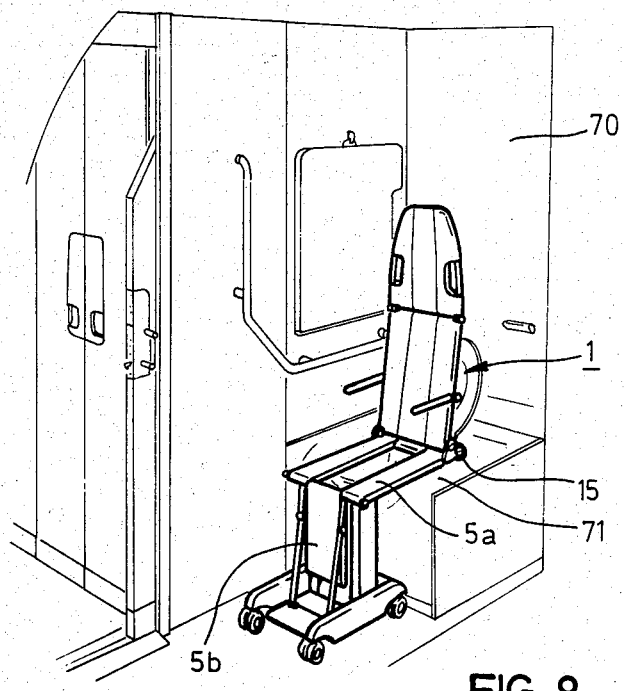
FIG. 8 illustrates the use of the present wheel chair over a toilet seat in a public transportation.
Figure 9:
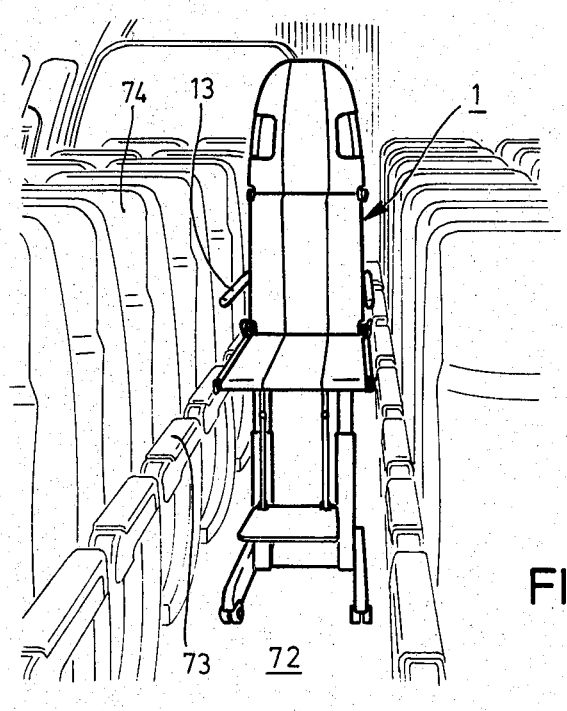
FIG. 9 illustrates the use of the present seat in the aisle of an aircraft or bus with the wheel chair seat elevated to the level of the arm rests of the seating adjacent to the aisle.

FIGS. 8 and 9 illustrate a practical use of the present chair in an aircraft. FIG. 8 shows how an invalid may use a toilet 70 with the aid of the present wheel chair. The attendant opens the normal toilet seat and lifts the wheel chair seat 5 to the level of the toilet seat 71. Thereafter, the center seat portion 5*b* is tilted downwardly as described above with reference to FIGS. 2 and 4. Then, the seat with its lateral portions 5*a* is shifted rearwardly so that the roller 15 may roll upwardly on the toilet seat surface 71. Incidentally, instead of a single roller extending the width of the chair, two separate rollers may be used which would be journalled to the respective sides at the rear edge of the seat 5.

FIG. 9 illustrates how the present chair 1 may be moved in an aisle 72. The aircraft is equipped with passenger seating 74 having arm rests 73 facing the aisle. With the aid of the above described drive means the seat 5 may be lifted to the level of the passenger seat while the respective arm rest 73 is tilted out of the way in an upward direction. Thus, the invalid is able to slide from his wheel chair seat onto his passenger seat. The present chair may be used in a same manner in buses, in theaters, or any other public or private rooms having narrow aisles. Such use is a distinct advantage of the present invention.

It is to be understood that the individual components of the wheel chair such as rests, handle bars and so forth, which components are foldable about journal axes, are constructed to be arrestable in the use position and in the folded condition, in order to assure a trouble-free function of the wheel chair. For this purpose respective locking devices are provided. FIGS. 10 and 11 show such a locking device 80, as is provided, for example, for arresting of the handle bars 12. The device 80 comprises substantially a grooved member 81 rigidly connected to the right side seat section 5*a* shown in FIG. 1, a locking member 82 rotatable about the axis 24, but rigidly secured to the right handle bar, and an actuating member 83 having a thumb area 84 and a latch bar 85. The actuating member 83 is supported to be rotatable relative to the locking member 82 about an axis 86, whereby a spring, not shown here, is provided in such a way, that the spring exerts a torque moment on the actuating member 83, whereby the latch bar 85 is pressed into a groove 88 of the grooved member 81.

FIG. 10 shows the locking device 80 in the rest position, that is, the right handle bar 12 rests in parallel to the seat section 5*a*. Here, the latch bar 85 engages in the groove 88 so that the handle bar 12 cannot be tilted unintentionally about the axis 24. In order to bring the handle bar 12 into the use position shown in FIG. 1, the latch bar 85 is tilted out of the groove 88, by applying thumb pressure to the thumb area 84, to such an extent as shown in FIG. 11, that the handle bar 12 with the locking member 82 may be rotated. The grooved member 81 has a further, not visible groove for the use position so that the latch bar 85, upon rotation of the handle bar 12 and thus of the locking member 82 in the direction of the arrow 89, engages into said further groove due to the force of said above mentioned spring to thereby arrest the handle bar in the predetermined use position. In order to fold the wheel chair the arresting is released by applying thumb pressure on the area 84 and rotating the handle bar 12 back into the starting position, whereby the latch bar 85 again engages in the groove 88.

The FIGS. 12 and 13 show some details of a journal connection 90 interconnecting a slidable tubular member 11 with a slide rail section 17. The connection 90 comprises substantially two eyes 91 rigidly secured to the slidable tubular member, a further eye 92 rigidly secured to the slide rail section 17, and a bolt 93 arranged concentrically to the axis 39. The mentioned elements form a hinge permitting a journalling motion of the slide rail section 17 relative to the slidable tubular member 11. A spring biased operating lever 95 having a hook 96 is mounted for tilting about a further axis 94 secured to the slidable tubular member 11. The further axis 94 is spaced from said axis 39. Thus, the operating lever 95 with its hook 96 is urged by a spring not shown, in the direction of the arrow 97 against a stop not shown, in such a manner that the hook 96 takes up the position shown in FIG. 13.

A pin 98 is secured to the slide rail section 17 with a spacing from the axis 39 so that it provides together with the hook 96 an arresting mechanism. If the slide rail section 17 is brought into the position shown in FIG. 12, the hook 96 is tilted by the pin 98 against the force of the spring with the aid of a bevel 99 out of the above described position until the pin 98 is located below the hook 96 and which returns into the old position. Thus, the slide rail section 17 is arrested in the use position. To release the arresting a thumb pressure on the operating lever 95 is sufficient whereby the hook 96 again releases the pin 98.

Although the invention has been described with reference to specific example embodiments, it will be appreciated that it is intended to cover all modifications and equivalents within the scope of the appended claims.

What is claimed is:

1. A foldable wheel chair having a central plane of substantial symmetry extending vertically through the chair, comprising base means (2, 3), foldable components including a bipartite support structure (4) normally extending vertically from said base means, seat means (5) supported by said bipartite support structure (4), backrest means (6, 7) secured to said seat means, wherein said backrest means comprise a lower backrest portion (6) and an upper headrest portion (7), footrest means (8) secured to said seat means (5), horizontally extending journal means extending perpendicularly to said central plane of substantial symmetry and connected to said foldable components for folding said foldable components, guide track means (18) secured to said seat means (5), said guide track means extending in parallel to said vertical central plane, and guide rail sections (17) pivoted to said support structure (4) and sliding in said guide track means for sliding said seat means horizontally back and forth, said horizontally extending journal means for folding said foldable components comprising first journal axle means (25) for journalling said upper headreast portion (7) back (arrow 26) against said lower backrest portion (6), second journal axle means (30) for journalling said lower backrest portion (6) down (arrow 31) against said seat means (5), third journal axle means (35) for journalling said footrest means (8) back (arrow 33) under said seat means (5), fourth journal axle means (37) for journalling said support structure (4) forward into said base means (2), and fifth journal axle means (39) for journalling said seat means (5) down to said base means (2), so that said guide track means (18) slies back in said guide rail sections (17) wherein said horizontally extending journal means include locking means for maintaining an operative position.

2. The chair of claim 1, wherein said bipartite support structure comprises two telescoping tubular members (4*a*, 11) extending normally vertically and perpendicularly to said base means, said fourth journal axle means (37) foldable securing said telescoping tubular members to said base means (2) for folding said tubular members into a position in parallel to said base means, and drive means (47*a*, 47*b*; 51*a*, 51*b*) operatively connected to one of said telescoping tubular members (11) and to said base means for vertically adjusting the seat means (5).

3. The chair of claim 2, wherein said two telescoping tubular members (4*a*, 11) have a sufficient extension length and wherein said drive means have a sufficient stroke for lifting said seat means (5) to a level above an arm rest adjacent to an aisle in a bus, airplane or the like.

4. The chair of claim 2, wherein said drive means comprise hydraulic piston cylinder means (47*a*, 47*b*) inside each of said telescoping tubular members (4*a*, 4*b*), whereby a piston rod (46) of said piston cylinder means is operatively connected to an extendable tubular member (11) inside each of said telescoping tubular members (4*a*), said drive means further comprising pump means (51*a*, 51*b*) hydraulically connected to said piston cylinder means (47*a*, 47*b*), and actuating means (10) operatively connected to said pump means (51*a*, 51*b*) for operating said hydraulic piston cylinder means (47*a*, 47*b*) through said pump means.

5. The chair of claim 4, wherein said actuating means comprise a bail (10) located in said base and operatively connected to said pump means for actuating the pump means by a foot of an operator.

6. The chair of claim 4, further comprising a separate hydaulic control circuit for each of said hydraulic piston cylinder means, each hydraulic control circuit comprising a pump cylinder (51*a*, 51*b*) of said pump means, a first non-return valve (57) forming a pressure supply branch for said separate hydraulic control circuits, a second non-return valve (58) forming a suction branch for said separate hydraulic control circuits, a manually operable seat lowering valve (52, 53) in each of said separate hydraulic control circuits, and actuator means (54, 55) connected to said seat lowering valves (52, 53) for lowering the seat (5), (FIG. 6).

7. The chair of claim 4, further comprising a separate hydraulic control circuit for each of said hydraulic piston cylinder means, each separate hydraulic control circuit comprising a pump cylinder (51*a*, 51*b*) of said pump means, two non-return valves (57, 58; 62, 63) in each of said separate hydraulic control circuits, two operator actuable seat lowering valves (53, 60; 52, 61) connected in parallel to each other in each of said separate hydraulic control circuits, and actuator means (54, 55) connected to said seat lowering valves for lowering the seat (5), (FIG. 7).

8. The chair of claim 6 or 7, wherein said actuator means (54, 55) are operable manually and/or by foot.

9. The chair of claim 6 or 7, further comprising return flow branches (64, 65) in said hydraulic control circuits, and volume flow meter means (64', 65') connected in said return flow branches (64, 65), said volume flow meter means (64', 65') being interconnected to each other to provide for a flow equalization in said hydraulic control circuits.

10. The chair of claim 1, wherein said seat means (5) comprises two lateral seat sections (5*a*) arranged to provide a spacing between these lateral seat sections, a central seat section (5*b*), and wherein said journal means further comprise sixth journal axle means (24) extending along and interconnecting a forward edge of said seat sections, said central seat section (5*b*) being hinged to said sixth journal axle means (24) for tilting said central seat section downwardly.

11. The chair of claim 10, further comprising handle bars (12) journalled to said sixth journal axle means (24)

for tilting said handle bars (12) through an angular range including a position in which each handle bar extends substantially in parallel to its adjacent lateral seat section (5*a*).

12. The chair of claim 1, further comprising roller means (15) rotatably secured to a rear edge of said seat means (5) for rotation about an axis (16) extending perpendicularly to said plane of symmetry for rolling said seat means along a support.

13. The chair of claim 1, further comprising automatic seat belt means (19), take-up roller means (20) secured to the back of said backrest means, and guide members (22) secured to the sides of said backrest means for guiding said automatic seat belt means (19) which extends around the backrest means (6, 7).

14. The chair of claim 1, wherein said guide track means (18) and said guide rail sections (17) cooperate for shifting the seat means rearwardly in a direction extending in said central plane of substantial symmetry.

15. The chair of claim 1, further comprising handgrip means (23) in said upper headrest portion (7), especially for carrying the chair in its folded condition.

16. The chair of claim 1, further comprising arm rest means (13) and seventh journal axle means (27) for foldably securing said arm rest means (13) to said backrest means.

* * * * *